United States Patent [19]

Foster

[11] 4,155,136

[45] May 22, 1979

[54] SOUND DEADENING IN ULTRASONIC HEEL ATTACHER

[75] Inventor: John C. Foster, Wigston, England

[73] Assignee: USM Corporation, Farmington, Conn.

[21] Appl. No.: 898,179

[22] Filed: Apr. 20, 1978

[30] Foreign Application Priority Data

Nov. 19, 1977 [GB] United Kingdom ..... 48259/77

[51] Int. Cl.[2] ..... A43D 25/00; G10K 11/00

[52] U.S. Cl. ..... 12/147 R; 12/42 B; 181/175

[58] Field of Search ..... 12/42 R, 42 B, 50, 43, 12/43.5, 147 R; 181/175, 198, 200, 201, 202, 203, 204, 205; 36/12

[56] References Cited

U.S. PATENT DOCUMENTS

| | | | |
|---|---|---|---|
| 2,072,109 | 3/1937 | Howard | 12/42 B |
| 2,144,143 | 1/1939 | Coll | 12/42 B |
| 2,168,606 | 8/1939 | Movsesian | 36/12 |
| 2,423,908 | 7/1947 | Small | 12/147 R |

FOREIGN PATENT DOCUMENTS

| | | | |
|---|---|---|---|
| 26460 | 12/1963 | German Democratic Rep. | 181/175 |

*Primary Examiner*—Patrick D. Lawson

*Attorney, Agent, or Firm*—Carl E. Johnson; Richard B. Megley; Vincent A. White

[57] ABSTRACT

Intensity of vibrations emitted by tool and workpiece acted upon is reduced by an enveloping mat of floppy fibres. In a heel attacher, for instance, the mat reduces by 14 or more decibels, and an operator incurs no risk of injury to his hands should they be in the path of the mat when it is moved to or from a heel and shoe being attached.

6 Claims, 2 Drawing Figures

SOUND DEADENING IN ULTRASONIC HEEL ATTACHER

CROSS-REFERENCE TO RELATED APPLICATION

An application Ser. No. 834,989 filed Sept. 20, 1977 in the name of Francis F. H. Rawson pertains to heel attaching by the use of ultrasonic frequency vibration of a fastener.

BACKGROUND OF THE INVENTION

This invention is concerned with improvements in or relating to machines which use ultrasonic vibrations.

Ultrasonic vibrations are used in a number of industrial operations and it is desirable that operators are not subjected to a high level of ultrasound created by such vibrations because, although such ultrasound cannot be heard, it can damage an operator's hearing. In some circumstances, it is relatively easy to shield an operator from ultrasound. For example, where ultrasonic vibrations are used to agitate a liquid in a mixing process, the tank containing the liquid can be surrounded with material which absorbs ultrasound.

However, in many operations involving ultrasonic vibrations, it is difficult to shield an operator or nearby personnel, effectively. For example, where a tool is vibrated at ultrasonic frequency against a workpiece in order to generate heat, for welding, embossing or inserting a member into a workpiece, considerations of workpiece accessibility make sound shielding difficult. This problem is made acute by the fact that ultrasound will "escape" through even a tiny gap in sheet material so that to shield by surrounding the workpiece and member by sheet material is often impractical. Furthermore, where the size of member and/or workpiece used may vary, suitably protective shielding is made even more difficult.

SUMMARY OF THE INVENTION

It is one of the various objects of the present invention to provide an improved method of carrying out a process which involves a member being vibrated against a workpiece at ultrasonic frequency, in which method the ultrasound emitted is reduced.

There is hereinafter described in detail a method of carrying out a process which involves a member being vibrated against a workpiece at ultrasonic frequency, which method is illustrative of the invention. The illustrative method is described in relation to an illustrative apparatus which is for attaching heels to shoes. The illustrative apparatus comprises vibrating means including a transducer operable to vibrate a member in the form of a staple against a workpiece in the form of a shoe heel made of thermoplastics material. The vibration of the staple against the heel is at ultrasonic frequency and causes the material of the heel to be softened allowing the staple to be pressed into the heel becoming embedded therein and thereby attaching the heel to a shoe. The illustrative apparatus also comprises a mat of floppy cords made, for instance, of cotton which mat is in two portions, and moving means, for example in the form of a piston cylinder assembly, which is operable to move the mat to and from an operative position thereof.

In the illustrative method, the ultrasound emitted as the staple is vibrated against the heel is reduced by enveloping the staple and a portion of the heel adjacent to the staple in the mat of floppy cords so that the staple and said portion of the heel are covered by a plurality of layers of the cords. When the mat envelops the staple and the heel, it is in its operative position which it reaches by the two portions of the mat being moved in from opposite directions.

The mat of the illustrative apparatus comprises a plurality of cotton cords each of which comprises a plurality of fibres which are plaited together. The cords are elongated and are floppy in that they are not resilient so that they can readily fit closely around the shoe and heel. The mat thus forms a shield of ultrasound absorbing material which will readily conform to the shape of a workpiece.

It is believed that the ultrasound absorbing properties of the mat derive from the presence in the mat of a large number of air pockets. A material with a large number of air pockets such as a foam material exhibits good ultrasound absorbing characteristics but, being resilient or rigid, will not readily conform to the shape of a workpiece.

The invention provides, in one of its several aspects, a method of carrying out a process which involves a member being vibrated against a workpiece at ultrasonic frequency, the method comprising enveloping the member and the portion of the workpiece adjacent to the member in a mat of floppy cords so that the member and said portion of the workpiece are surrounded by a plurality of layers of the cords.

The invention provides, in another of its several aspects, an apparatus comprising vibrating means operable to cause a member to vibrate against a workpiece at ultrasonic frequency, a mat of floppy cords, and means operable to move the mat into an operative position thereof in which it envelops the member and a portion of the workpiece adjacent to the member so that the member and said portion of the workpiece are surrounded by a plurality of layers of the cords.

BRIEF DESCRIPTION OF THE DRAWINGS

The above and other of the various objects and several aspects of the invention will become more clear from the following detailed description, to be read with reference to the accompanying drawings, of the illustrative apparatus and method aforementioned. It is to be understood that the illustrative apparatus and method have been selected for description by way of example and not of limitation of the invention.

In the accompanying drawings.

DESCRIPTION OF THE PREFERRED EMBODIMENT

Figure 1:
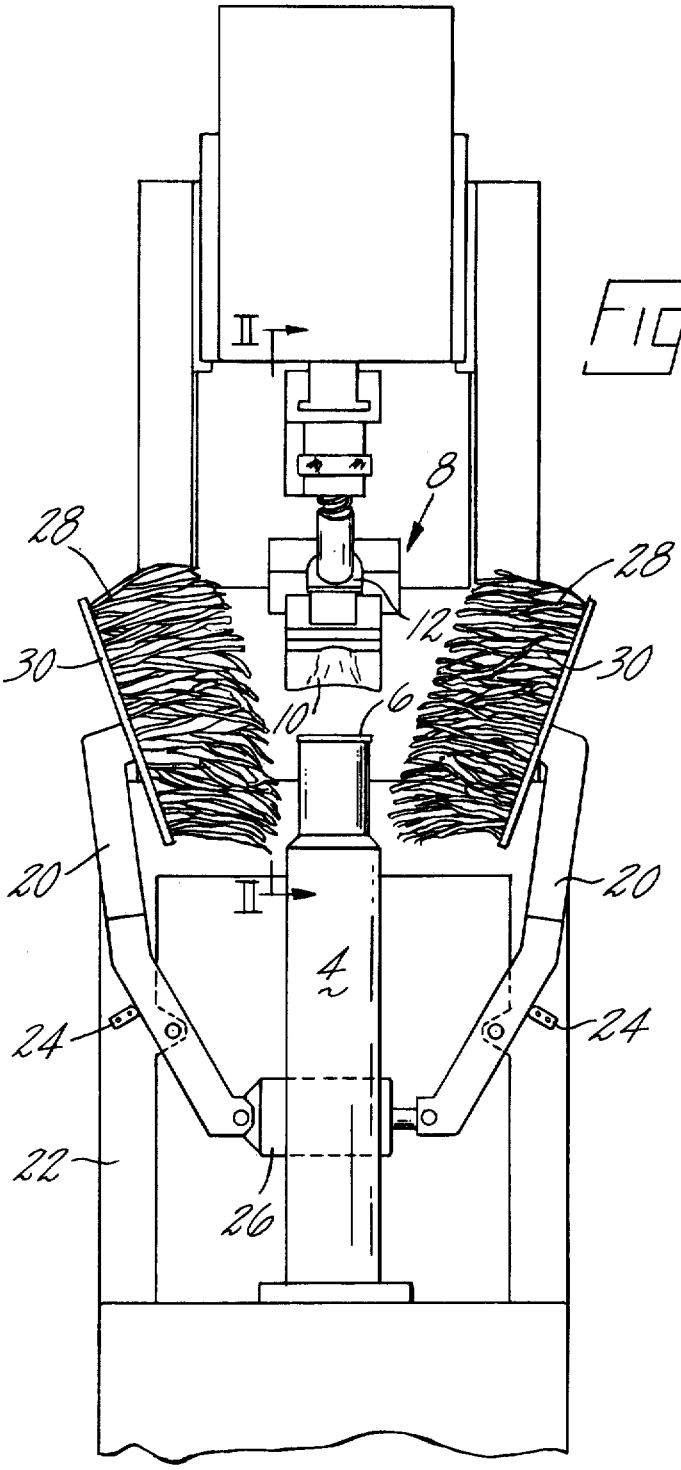
FIG. 1 is a front elevational view of the illustrative apparatus for attaching heels to shoes.
Figure 2:
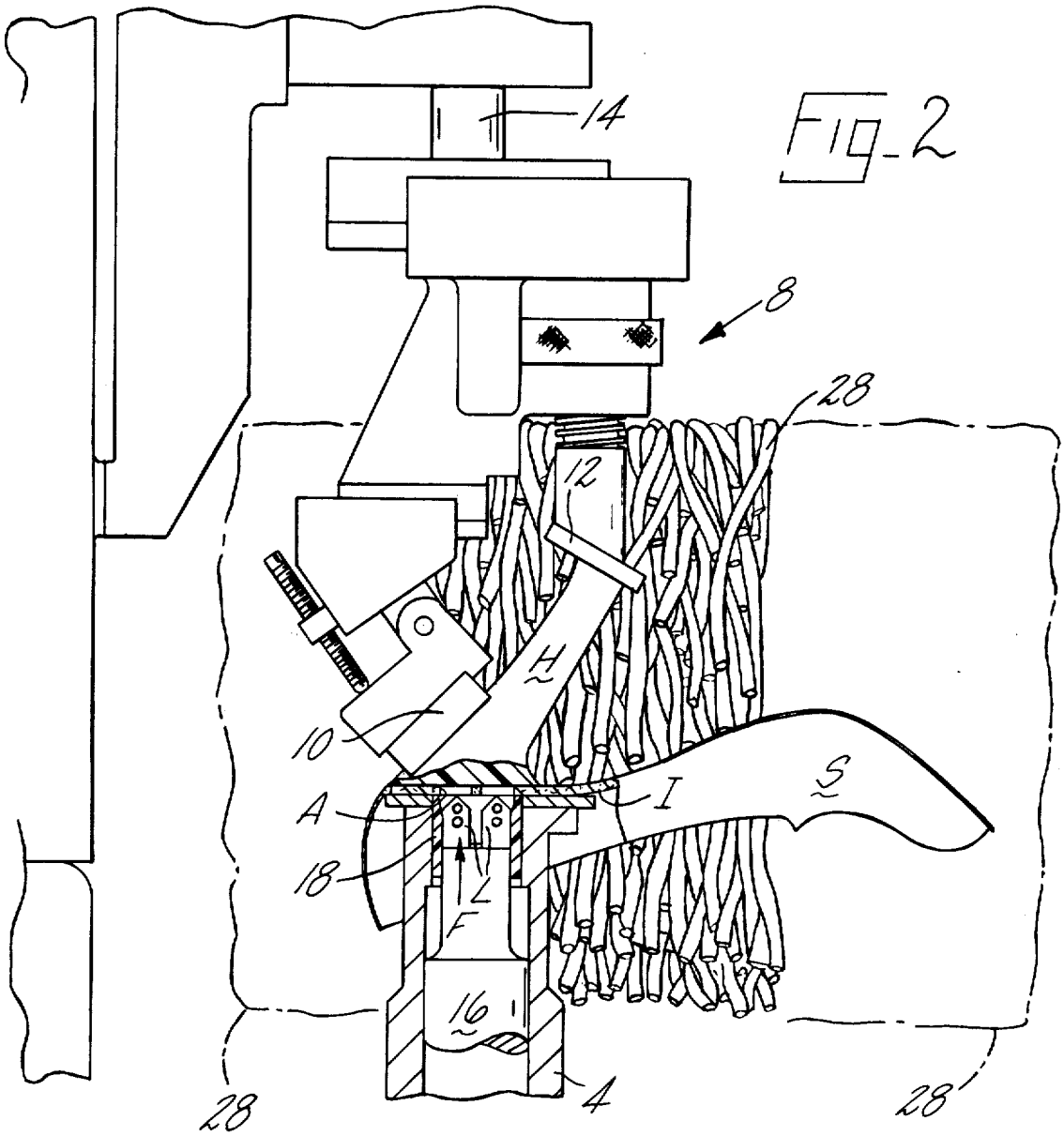
FIG. 2 is a view, on a larger scale than FIG. 1, taken on the line II—II in FIG. 1, showing a shoe and a heel therefor in position in the illustrative apparatus.

The illustrative apparatus shown in the drawings is arranged to attach heels made of thermoplastics material to shoes. The apparatus comprises a cylindrical stand 4 which is hollow and supports a gauge plate 6 on which a shoe S can be located. The shoe S is located by being fitted over the gauge plate 6 so that the gauge plate 6 engages a heel seat region of an insole I of the shoe S (see FIG. 2). With the shoe S located on the gauge plate 6, a heel H is positioned on the heel seat region of the shoe S on the opposite side thereof to the gauge plate 6, the heel H being made of thermoplastics material. When the heel H has been positioned on the shoe S, it is clamped in position by clamping means 8 of the apparatus. The clamping means 8 comprises a pad 10 (FIG. 2) which is arranged to engage a rearward face of the heel H and a pad 12 which is arranged to engage a ground-engaging surface of the heel H. The clamping means 8 also comprises a piston and cylinder assembly of which the piston 14 is visible in FIG. 2. The piston and cylinder assembly is operable to move the pads 10 and 12 downwards into clamping engagement with the heel H.

The hollow stand 4 contains a magnetostrictive vibrator transducer (not shown) for vibrating a tool 16 (FIG. 2) at ultrasonic frequency. The transducer, as it is surrounded by the stand 4 does not itself give rise to an ultrasound hazard to the operator of the apparatus. The stand 4 supports a bush 18 into which a staple F can be introduced through a hole in the gauge plate 6 so that the staple F rests on the tool 16. The staple F is a head and two legs L projecting from each side of the head, each of the legs L having two holes therethrough.

In the operation of the illustrative apparatus by the illustrative method, a staple F is introduced into the bush 18, a shoe S is located on the gauge plate 6, a heel H is located on the heel seat of the shoe S, and the clamping means 8 is used to clamp the heel H in position. Next, the tool 16 is moved upwards by means of a piston and cylinder assembly (not shown) so that the staple F is pushed through precut slots A in the insole I of the shoe S and is pressed against the heel H. The transducer now causes the tool 16 and therefore the staple F to vibrate at ultrasonic frequency so that the staple F heats the portion of the heel H adjacent thereto softening the material of the heel H. The staple F is pressed into the heel H becoming embedded therein with the softened material flowing around the legs L and into the holes in the legs L. When the staple F has become embedded in the heel H, the staple F secures the heel H to the shoe S.

The illustrative apparatus also comprises two levers 20 pivotally mounted on a frame 22 of the apparatus. Each of the levers 20 is pivotal between a rest position (shown in FIG. 2) in which the lever 20 rests against a stop 24 mounted on the frame 22, and an operative position to which it is moved by means of a piston and cylinder assembly 26 to the piston of which a right hand one of levers 20 is pivotally connected and to the cylinder of which a left hand one of the levers 20 is pivotally connected. Operation of the piston and cylinder assembly 26 to move the piston out of the cylinder moves the levers 20 to their operative position.

Each of the levers 20 carries at an upper end portion thereof a mat portion 28 of floppy cords which are supported on a support plate 30. The cords of the mat portion 28 are made of plaited cotton fibres and each cord is approximately 9 inches long and one-eighth of an inch in diameter. When the levers 20 are in their operative positions, the cords of the two mat portions 28 form a mat which envelops the upper portion of the stand 4 containing the staple F, the shoe S, and the heel H. The cords wrap themselves around the shoe S and the heel H covering them with six or more layers of cords 28. The piston and cylinder 26 constitute means operable to move the mat of the illustrative apparatus into an operative position thereof in which it envelops the staple F and the heel H.

In the operation of the apparatus by the illustrative method, the levers 20 are moved to their operative positions after the heel H has been clamped in position and before the transducer is operated. The enveloping of the ultrasound-producing parts of the apparatus by a plurality of layers of the cords 28 reduces the emission of ultrasound by a considerable degree.

A decibel counter was positioned in front of the illustrative apparatus and readings were taken as follows:

With the transducer operating at 20 KHz. and shoe and heel in position:

Total Decibel Count (all frequencies)

Without mat in position = 114 decibels.
With mat in position = 100 decibels.

Decibel Count in Octave Centered on 16 KHz.

Without mat in position = 114 decibels.
With mat in position = 100 decibels.

Decibel Count in Octave Centered on 8 KHz.

Without mat in position = 105 decibels.
With mat in position = 85 decibels.

These results show that, as expected since the operation is at 20 KHz., most of the Ultrasound was in the Octave Centered on 16 KHz. and both this and lower frequencies were reduced substantially by the mat. It should be borne in mind that the decibel scale is logarithmetic.

The above readings were repeated without a shoe and heel or staple in position with the following results:

Total Decibel Count

Without mat in position = 119 decibels.
With mat in position = 87 decibels.

Decibel Count in Octave Centered on 16 KHz.

Without mat in position = 119 decibels.
With mat in position = 87 decibels.

Decibel Count in Octave Centered on 8 KHz.

Without mat in position = 85 decibels.
With mat in position = 57 decibels.

These results show that where the mat can conform more easily to the required shape the reduction in ultrasound is greatest, the mat can conform more easily to the shape of the gauge plate 6, as it was doing in the second set of results, than it can to the shape of a shoe and heel. However, in both cases, very significant reductions in Ultrasound were recorded.

The use of a mat for deadening ultrasound has the added advantage that the mat can be brought into its operative position without any risk of causing injury to an operator who does not need to remove his hands from the path of the mat portions.

Having thus described my invention, what I claim as new and desire to secure as Letters Patent of the United States is:

1. The method of reducing ultrasound emission when a member is vibrated at ultrasonic frequency against a workpiece, said method comprising enveloping at least adjacent portions of the member and the workpiece in a mat of floppy cords disposed in a plurality of layers.

2. The method of attaching a heel to a shoe comprising directing ultrasonic frequency vibration to a fastener as it is pressed into the heel and causing a plurality of floppy cords to surround the heel and the fastener as the fastener is driven.

3. Apparatus comprising vibrating means operable to cause a member to vibrate against a workpiece at ultrasonic frequency, at least one movable mat of floppy cords, and means for moving the mat from an inoperative position to surround the member and a portion of the workpiece adjacent thereto thus to deaden ultrasound emission.

4. Apparatus as in claim 3 wherein said mat is layered and said cords are of cotton.

5. Apparatus as in claim 3 wherein said member is a fastener driving tool, and said mat moving means is adapted to carry a pair of movable mats of said cords, one from each of the opposite sides of the workpiece into enveloping relation to the tool, the fastener to be driven thereby and the adjacent workpiece portion.

6. Apparatus as in claim 3 wherein the mat moving means comprises a piston-cylinder device, and a pair of levers respectively pivotally actuatable by the device, each of the levers being arranged for carrying one mat into operating relation to the workpiece prior to operation of said vibrating means.

* * * * *